United States Patent [19]

McTighe et al.

[11] 3,969,133

[45] July 13, 1976

[54] METHOD FOR SELF-CLEANING A RESTROOM

[76] Inventors: Gilbert T. McTighe, 804 N. Winsor St., Apt. 10, Mitchell, S. Dak. 57301; Sture A. Johansson, Bunett Gardens Apt. 147, Kendall Park, N.J. 08824

[22] Filed: June 25, 1974

[21] Appl. No.: 483,081

Related U.S. Application Data

[62] Division of Ser. No. 140,227, May 4, 1971, Pat. No. 3,837,011.

[52] U.S. Cl. ..... 134/21; 134/18; 134/24; 134/26; 21/DIG. 2

[51] Int. Cl.[2] ..... B08B 3/02; B08B 3/04

[58] Field of Search ..... 4/1, 145, 146, 173, 4/233; 134/167 R, 168 R, 169 R, 18, 21, 22 R, 24, 34, 26; 137/625, 47

[56] References Cited

UNITED STATES PATENTS

| | | | |
|---|---|---|---|
| 1,628,141 | 5/1927 | Gray | 134/22 R X |
| 2,817,606 | 12/1957 | Barrett | 134/22 R |
| 2,915,072 | 12/1959 | Merritt | 134/21 X |
| 3,381,312 | 5/1968 | Whitla | 4/1 |
| 3,445,286 | 5/1969 | Smith et al. | 134/34 X |
| 3,447,166 | 6/1969 | Gordon | 4/1 |
| 3,460,988 | 8/1969 | Kennedy et al. | 134/24 X |
| 3,742,520 | 7/1973 | Bernardi | 4/145 X |

*Primary Examiner*—Barry S. Richman
*Attorney, Agent, or Firm*—Bacon & Thomas

[57] ABSTRACT

A restroom is automatically cleaned by moving a vertically disposed spray boom in a manner so as to generally track the interior periphery of the restroom enclosure to spray both the inner sidewall of the enclosure and the fixtures mounted therewithin with cleansing fluid, the fluid then being drained from the enclosure, after which any accumulated vapors are exhausted. Heated drying air is then passed through the enclosure to complete the cleaning cycle.

7 Claims, 6 Drawing Figures

METHOD FOR SELF-CLEANING A RESTROOM

This application is a division of co-pending application Ser. No. 140,227, filed May 4, 1971, now U.S. Pat. No. 3,837,011.

BACKGROUND OF THE INVENTION

1. Field of the Invention

The present invention relates generally to the cleaning of restrooms, and more particularly to a method for automatically cleaning restrooms.

2. Description of the Prior Art

Gasoline filling stations and other similar structures are commonly provided with restrooms for the convenience of the general public, such restrooms commonly including a water closet and a lavatory or wash basin, and possibly other fixtures. Because of the continuous use by transients such facilities need frequent cleaning, the accommodation of which need places considerable and unwelcome demands on otherwise busy operating personnel.

There is thus a need for an easy method for cleaning a restroom, preferably one that can be carried out automatically so that minimum demands are placed on busy employees. The present invention is directed to satisfying that need.

SUMMARY OF THE INVENTION

A restroom of the type to which the present method relates includes an upright enclosure having a sidewall and a bottom wall, the sidewall having an access door mounted thereon. The bottom wall has a drain therein, and supports a pedestal that extends centrally upwardly through the enclosure. The upper end of the pedestal supports a top wall, the periphery of which is spaced from the enclosure sidewall to provide an annular flow space therebetween.

The pedestal also serves as the support for a water closet, a lavatory or sink, a fixture for holding tissue, a dryer for the hands, and necessary lighting fixtures. Thus, none of these items need be mounted on the container sidewall, a feature that contributes to the self-cleaning ease of the restroom. The pedestal and all of the bathroom fixtures and other items carried thereby are spaced from the enclosure sidewall.

A vertical spray boom is mounted by upper and lower tracks on the interior of the enclosure sidewall, and is arranged to travel around and generally track the interior periphery of the sidewall. It is in order to provide for this movement that the pedestal and the items supported thereon are spaced from the sidewall. The boom includes both inwardly and outwardly directed nozzles, and the upper end thereof extends through the annular flow space into the region above the enclosure top wall, where it is mounted on a carrier that runs on the upper support track and which is driven by a motor. The upper end of the spray boom is connected, through solenoid valves, to a source of cleansing fluid.

In order to provide for the movement of air through the restroom, the enclosure sidewall has a vent therein, and an exhaust fan is mounted in the enclosed region above the top wall. When the exhaust fan is operated, air is pulled into the enclosure through the vent, passes upwardly through the annular flow space that also serves to accommodate the upper end of the spray boom, and exits through the exhaust fan. The positions of the vent and the exhaust fan can be reversed, if desired.

A device for supplying heated, dry air to the enclosure is also provided, which device can for convenience be incorporated with the vent. The spray boom motor, the cleansing liquid supply apparatus, the exhaust fan, and the device for supplying heated air are all connected with a control unit, which when actuated will automatically operate each of these components in proper sequence to clean the restroom of the invention.

The present method of cleaning a restroom includes the sequential steps of spraying the interior of the restroom with cleansing fluid, draining away the resultant liquid, exhausting from the enclosure any accumulated vapors, and finally passing through the enclosure heated drying air. These steps are carried out according to the invention in the following way.

When it is desired to clean the restroom, the operator first picks up any scrap paper or the like, and applies any necessary detergent to loosen lipstick marks or the like. The door of the restroom is then closed, and the control unit is actuated.

Upon actuation of the control unit the restroom door is first automatically locked, to prevent anyone being injured by accidental opening thereof during a cleaning cycle. The spray boom is then placed in operation, and repeatedly moves around and generally tracks the interior periphery of the enclosure in alternating wash and rinse modes. The control unit then terminates operation of the boom and actuates the exhaust fan, which removes steam and other vapors from the enclosure while the used cleansing liquids are drained away. Finally, heated dry air is supplied to the enclosure, after which the control unit completes a cleaning cycle and unlocks the access door.

The restroom is then ready for further use, thorough cleaning thereof having been accomplished with minimum demands of time and effort on the operator or attendant. Because cleaning is an easy matter with the present method, the chore is likely to be performed whenever needed, which contributes to the sanitary and aesthetic comfort of customers or others using the facility.

It is a principal object of the present invention to provide a method for automatically cleaning a restroom.

Another object is to provide a method for self-cleaning a restroom, designed for easy operation and maximum sanitation and aesthetic appeal.

Other objects and many of the attendant advantages of the invention will become readily apparent from the following Description of the Preferred Embodiment, when taken together with the accompanying drawings.

DESCRIPTION OF THE PREFERRED EMBODIMENT

Figures 1, 2:
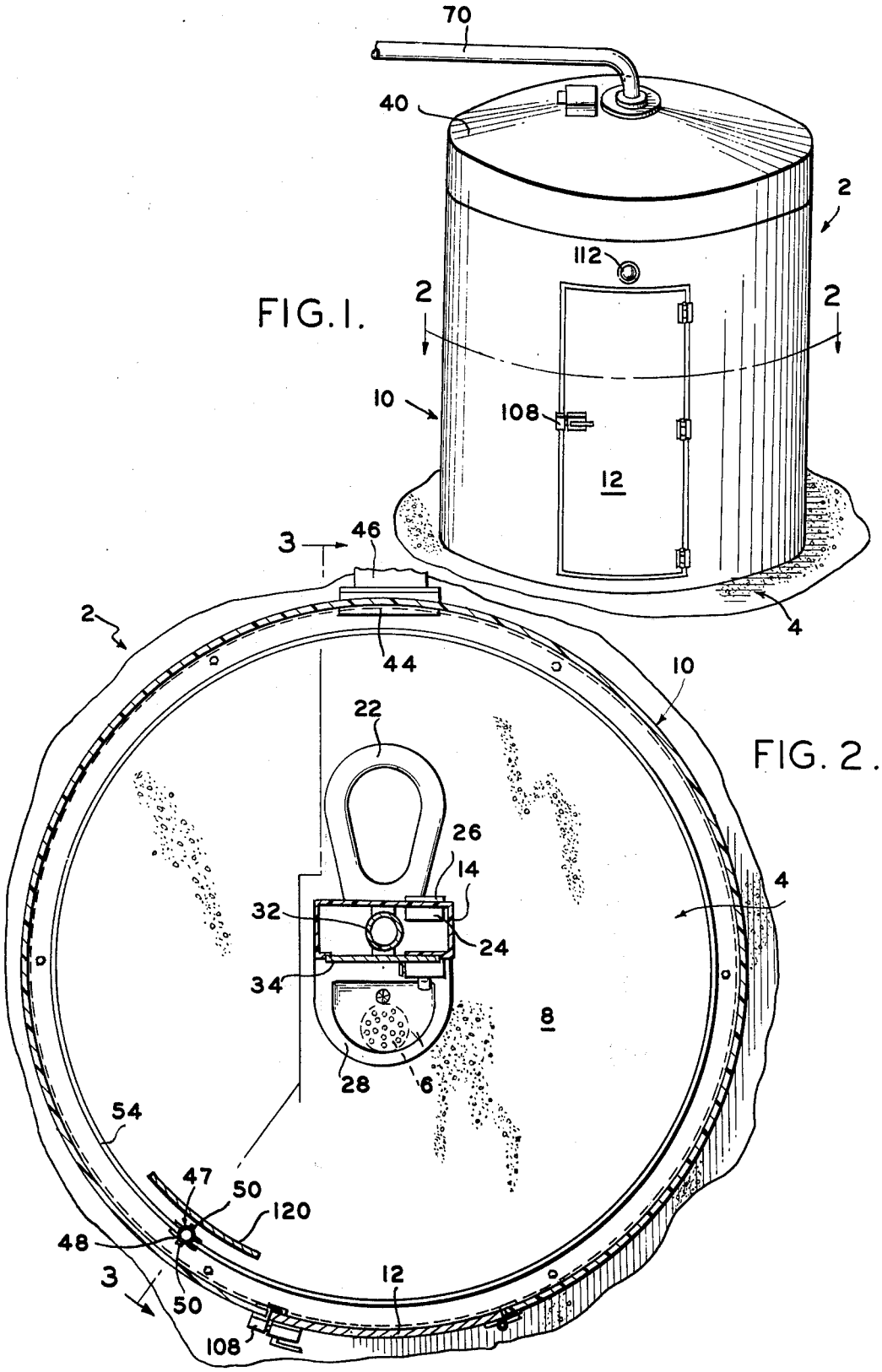
FIG. 1 is a perspective view of a modular restroom adapted for carrying out the method of the invention.
FIG. 2 is a horizontal sectional view taken along the line 2—2 of FIG. 1, showing the interior of the restroom.
Figure 3:
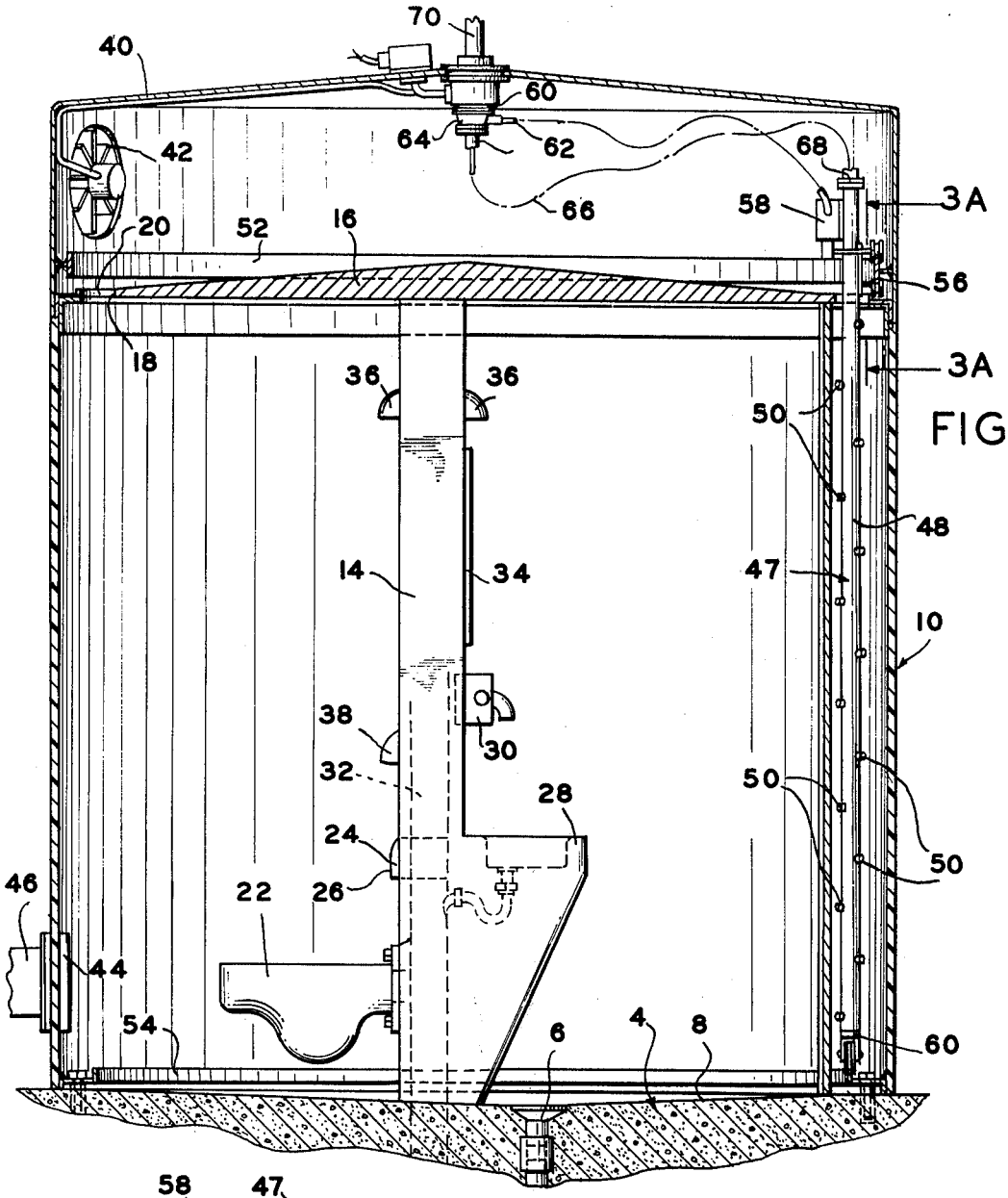
FIG. 3 is a vertical sectional view taken on the line 3—3 of FIG. 2 showing in detail the spray boom and other features of the invention.
Figure 3A:
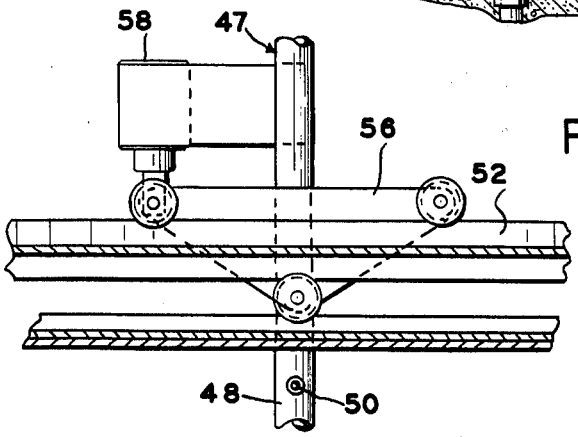
FIG. 3A is an enlarged view taken on line 3*a*—3*a* of FIG. 3, showing the upper carrier and track arrangement.
Figure 4:
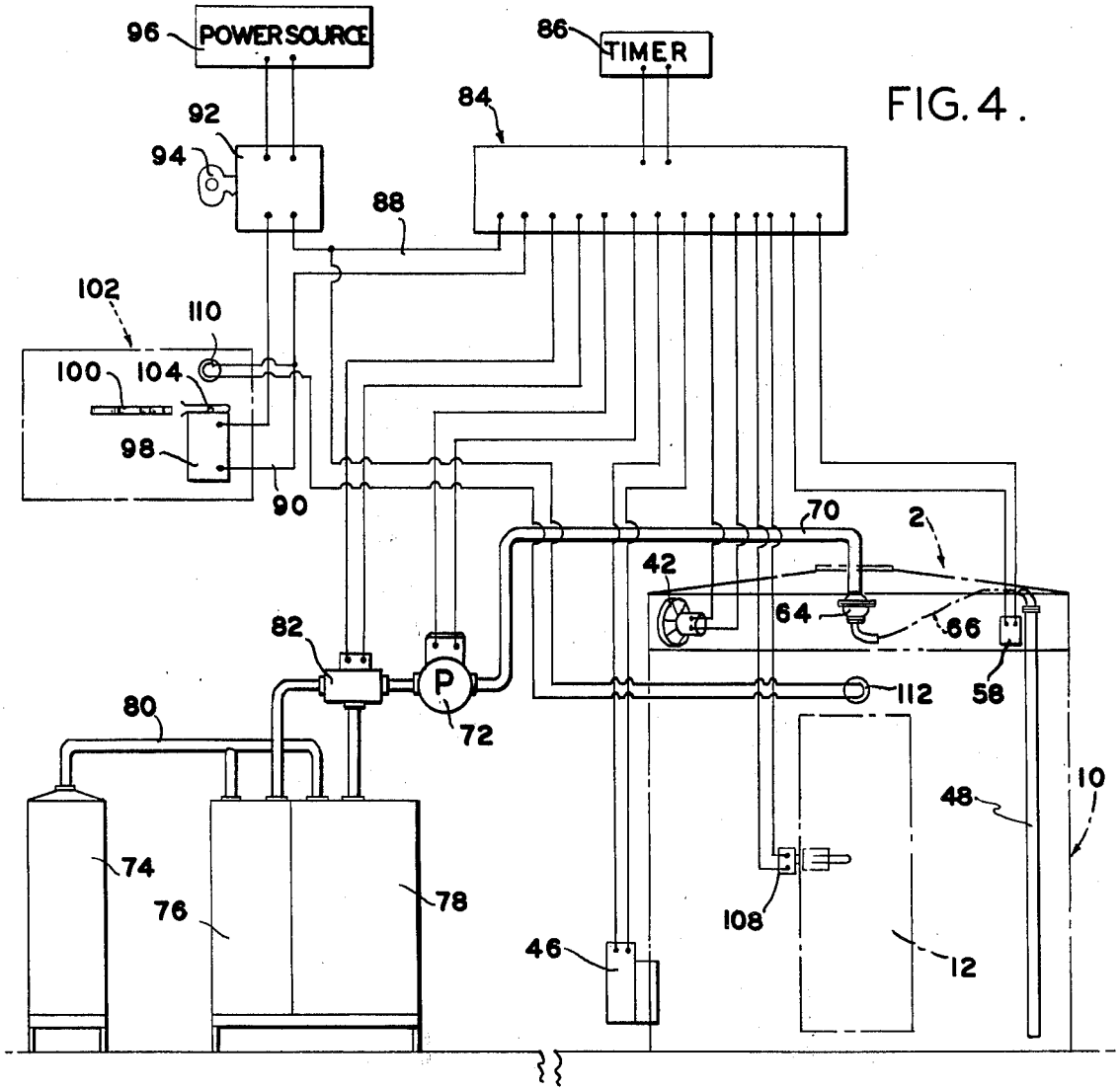
FIG. 4 is a diagrammatic view showing the fluid and electrical circuits of the invention.
Figure 5:
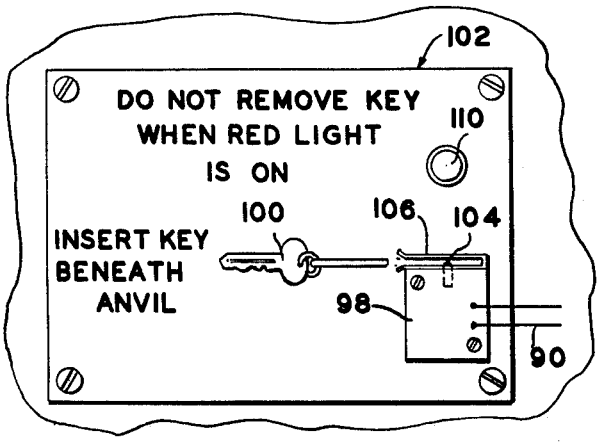
FIG. 5 is a front view of the public display plaque for holding the restroom key.

Referring now to the drawings, a modular restroom adapted for use with the method of the invention is shown at 2, the module being designed for installation within a building such as a restaurant or gasoline filling station. With suitable modifications to withstand the elements, it is to be understood that the restroom 2 can also be erected out of doors as a free standing structure, if desired.

The restroom 2 includes a circular floor 4 having a drain 6 therein, the upper surface 8 of the floor sloping downwardly toward the drain. Mounted on the floor 4 is an upright cylindrical enclosure 10 having a self-closing access door 12 therein, which enclosure can be made of metal, plastic or some other suitable material.

Positioned centrally within the cylindrical enclosure 10 and extending upwardly from the floor 4 is a hollow rectangular pedestal 14, the floor drain 6 being offset from the pedestal, and the pedestal being spaced from the enclosure sidewall 10. The pedestal 14 is utilized for mounting all bathroom fixtures, and supports at its upper end a circular roof 16. The peripheral edge 18 of the roof 16 is spaced from the cylindrical enclosure sidewall 10 completely therearound, to provide an annular flow space 20.

Mounted on the side of the pedestal 14 facing away from the door 12 is a one-piece watercloset 22 of the type that is easily washed down by spraying with cleansing liquid, a toilet tissue dispenser 24 being recessed into the pedestal 14 nearby and having a watertight lid 26 thereon that is normally held closed by magnets or some other suitable latch device. The side of the pedestal 14 facing the door 12 has a one-piece wash basin or lavatory 28 mounted thereon, again of a design that can be easily spray cleaned. Recessed in the pedestal above the lavatory 28 is an electric hand drier 30, designed and mounted to be unaffected by water sprayed thereon. The standpipe 32 for the fixtures 22 and 28 is contained within the pedestal 14, as is all electrical wiring, the pedestal being of a size so that a person can easily walk from one side to the other thereof.

Typically, the pedestal 14 will measure about 8 inches thick by about 18 inches wide, and the enclosure 10 will have a diameter of about 8 feet. A waterproof and unbreakable mirror 34 is mounted on the pedestal 14 above the lavatory 28, and waterproof lighting fixtures 36 are mounted at an elevated position on both sides of the pedestal. An ultraviolet ray sanitation device 38 is mounted in a waterproof manner on the pedestal 14 above the watercloset 22 for sanitizing the same after each use, and can be automatically controlled by a time switch (not shown) operated each time the door 12 is opened.

The cylindrical enclosure sidewall 10 extends above the pedestal-supported roof 16, and is closed by a ceiling structure 40 of suitable design. The wall of the enclosure 10 above the roof 16 has an exhaust fan unit 42 mounted therein, it being understood that said unit could also be mounted elsewhere. A vent 44 is mounted on the lower portion of the enclosure sidewall 10, and has a hot air blower 46 associated therewith. When the exhaust fan 42 is running, air is drawn in through the vent 44, passes through the annular flow space 20, and is exhausted.

The restroom 2 as described is specifically designed for being spray cleaned, all of the fixtures being suited to this purpose, and all electrical units and the tissue dispenser 24 being waterproof. Such spray cleaning is accomplished with spray apparatus 47 mounted within the enclosure 10, said apparatus including a vertically disposed spray boom 48 having spaced, inwardly and outwardly directed spray nozzles 50 mounted thereon.

The spray boom 48 is mounted on upper and lower continuous circular rails or tracks 52 and 54, respectively, secured to the interior of the cylindrical enclosure sidewall 10. The upper track 52 is disposed above the pedestal-supported roof 16, and the upper end of the boom 48 extends through the annular flow space 20 and is connected to a carrier unit 56 that rides on the track 52, and which includes an electric drive motor 58. The lower end of the boom 48 is connected to a carrier unit 60 that rides on the lower track 54. When the motor 58 is energized, therefore, the vertical boom will travel completely around and generally track the interior periphery of the cylindrical enclosure 10.

An armature-type electrical swivel joint 60 is suspended from the ceiling structure 40, and electrical cables 62 extend therefrom to the motor 58. Similarly, a fluid swivel joint 64 is also suspended from the ceiling structure 40, the outlet thereof being connected by a hose 66 to an inlet 68 on the upper end of the spray boom 48. Cleansing liquid is supplied to the inlet of the fluid swivel joint 64 by a conduit 70 connected to the outlet of an electric pump 72.

The preferable operating cycle for the spray boom 46 includes an initial pre-rinse with hot water, followed by a detergent-spraying period, and another rinse period. Hot water is supplied from a hot water heater 74 to a hot detergent reservoir 76 and a reservoir 78 for hot rinse water, through a conduit 80 and suitable valve mechanisms (not shown). A two-way solenoid valve 82 is connected to the inlet of the pump 72, one inlet of the valve 82 being connected to the reservoir 76, and the other inlet to the reservoir 78. The solenoid valve 82, the pump 72, the exhaust fan 42, the hot air blower 46 and the spray boom motor 58 are all connected to a control unit 84, for automatic operation.

The control unit 84 is a conventional cyclic switching unit, the duration of each step in the cycle being set on a time clock mechanism 86 included as a part of said unit. Electricity is supplied to the unit 84 through a pair of leads 88 and 90 connected to the output terminals of a master switch 92 operable by a key 94, the input terminals of the master switch 92 being connected to a power supply 96. Inserted in the power lead 88 is a key-operated micro safety switch 98.

The master switch 92 can be mounted on the enclosure 10 adjacent the door 12, or at some remote point. The safety switch 98 is intended to be mounted in a prominent location, where a user of the facility will come to pick up a key 100 to open the normally locked door 12. The switch 98 is mounted on a display plaque 102, and includes a pushbutton 104 having an anvil 106 mounted in confronting relationship. When the restroom 2 is not in use the key 100 is inserted under the anvil 106, depressing the pushbutton 104, and closing the switch 98. When the key 100 is removed, the switch 98 opens, thereby rendering the controller unit 84 inoperative. This arrangement is designed to help prevent accidental operation of the cleaning system while a person is in the restroom 2.

The present method for cleaning a restroom includes as a first step spraying the interior of the restroom with cleansing fluid, first with water, then with water containing a suitable detergent or cleaning agent, and finally with rinse water. The cleansing fluids are then drained away, any accumulated vapors are exhausted, and finally heated dry air is passed through the enclosure. Before beginning a cleaning cycle, the operator ascertains that the restroom 2 is empty, picks up any loose trash, and removes with detergent stains, lipstick marks and the like.

The method is carried out with the apparatus shown in the drawing by first placing the key 100 beneath the anvil 106 to close the safety switch 98, after which the key 94 is inserted into the master switch 92 for operating the same. When electricity flows through the leads 88 and 90, a solenoid lock 108 is energized to secure the access door 12, and warning lights 110 on the plaque 102 and 112 on the exterior of the enclosure 10 are illuminated. The control unit 84 is also energized, and the conventional switching circuits thereof operate the system in accordance with cycle times preset on the time 86.

The control unit 84 first energizes the motor 58 and actuates the solenoid valve 82 to connect the pump 72 to the hot water rinse tank 78, whereupon the pump 72 is energized to begin the pre-rinse cycle. During the pre-rinse cycle the spray boom 48 travels around the interior of the cylindrical enclosure 10, and the nozzles 50 act to thoroughly wet substantially everything within the restroom. When the time 86 terminates the pre-rinse cycle, the controller 84 actuates the solenoid valve 82 to connect it with the detergent reservoir 76, and the wash cycle commences. At the conclusion of the wash cycle, the valve 82 is again switched to the rinse water reservoir 78, and the spraying cycle is completed.

The controller unit 84 then deactivates the pump 72, the motor 58 and the solenoid valve 82, and starts the exhaust fan 42 to begin the exhaust step. The enclosure 10 is usually filled with fumes by the spray cycle, which fumes can be unpleasant depending on the detergent or cleaning agent employed. The liquids themselves are, of course, drained from the enclosure through the drain 6.

When the fumes have been removed from the enclosure 10 and draining of the fluids is essentially complete, the timer 86 causes the controller switch unit 84 to energize the hot air blower 46, thus flooding the restroom 2 with hot drying air. When this step is completed, the controller unit 84 deactivates the system, the key 94 is removed to turn off the warning lights 110 and 112 and to release the safety lock 108, and the facility is again ready for use. The spray boom 48 is moved behind a panel 120 mounted within the enclosure 10, to conceal the same when not in use.

It is readily seen that the present method makes it possible for a filling station or other business to consistently offer clean restroom facilities, the act of thorough cleaning being such an easy matter to accomplish. Thus, both management and consumers are benefited.

Obviously, many modifications and variations of the invention are possible, without departing from the teachings hereof. For example, other arrangements for a restroom can be employed with the method, and the bathroom fixtures can be located on the sidewall if desired, so long as the peripheral travel path for the spray boom is left free of obstruction.

We claim:

1. The method for cleaning a restroom, said restroom including an enclosure having at least one bathroom fixture mounted centrally therein, comprising: spraying the interior of said enclosure and all fixtures mounted therein with cleansing fluids by moving an elongated, vertical spray boom in a manner so as to generally track the interior periphery of said enclosure; draining said fluids out of said enclosure; evacuating from said enclosure vapors resulting from said spraying step; and passing heated drying air through said enclosure.

2. The method for cleaning a restroom, said restroom including an enclosure having bathroom fixture means mounted therein, said method including the steps of: moving a generally vertically disposed boom in a manner so as to generally track the periphery of the interior of said enclosure, said boom having a plurality of vertically spaced nozzles thereon arranged to direct spray both inwardly and outwardly over at least the vertical distance from the floor of said enclosure to above said bathroom fixture means; spraying fluids through said nozzles on said boom while said boom is being moved around the periphery of the interior of said enclosure, to effect cleansing of the interior of said enclosure and said fixture means; and draining spent fluid from said enclosure.

3. The method as recited in claim 2, wherein said step of spraying includes: spraying the interior of said enclosure and said fixture means first with water, then with water containing a suitable cleansing agent, and finally with rinse water.

4. The method as recited in claim 2, including the further steps of: evacuating from said enclosure vapors resulting from said spraying step; and passing drying air through said enclosure to complete a cleaning cycle.

5. The method for cleaning a restroom, said restroom including an enclosure having a sidewall with a door therein, a bottom wall, and bathroom fixture means disposed therewithin, said method including the steps of: moving a generally vertically disposed boom in a manner so as to generally track the periphery of the interior of said enclosure, said boom having a plurality of vertically spaced nozzles thereon arranged to direct spray both inwardly and outwardly over at least the vertical distance from the bottom wall of said enclosure to above said fixture means; spraying cleansing and then rinsing liquids through said nozzles on said boom while said boom is being moved around the periphery of the interior of said enclosure, to effect cleansing of the interior of said enclosure and said fixture means; draining spent fluid from said enclosure; and passing drying air through said enclosure.

6. The method as recited in claim 5, including the additional step before passing drying air through said enclosure of: evacuating from said enclosure vapors resulting from said spraying step.

7. The method as recited in claim 6, including additionally the initial step of locking said door of said enclosure before moving said boom, and the final step after passing drying air through said enclosure of unlocking said door.

* * * * *